US005720199A

United States Patent [19]

Dischler

[11] Patent Number: 5,720,199

[45] Date of Patent: Feb. 24, 1998

[54] TOOL FOR TRANSFORMING WORK PIECES

[76] Inventor: Helmut Dischler, Droste-Hulshoff-Str. 9, D-41464 Neuss, Germany

[21] Appl. No.: 286,177

[22] Filed: Aug. 5, 1994

[30] Foreign Application Priority Data

Aug. 5, 1993 [DE] Germany ..... 43 26 337.2

[51] Int. Cl.[6] ..... B21J 9/18

[52] U.S. Cl. ..... 72/453.03; 72/453.02; 72/449; 72/454; 72/452.4

[58] Field of Search ..... 72/410, 412, 416, 72/443, 449, 450, 452.4, 454, 453.04, 453.03; 74/105

[56] References Cited

U.S. PATENT DOCUMENTS

| | | | |
|---|---|---|---|
| 2,210,510 | 8/1940 | Sutton | 140/93.2 |
| 2,467,020 | 4/1949 | Fischer | 74/110 |
| 3,830,615 | 8/1974 | Walchhuetter | 72/453.04 |
| 3,847,007 | 11/1974 | Brownbill | 72/450 |
| 4,282,739 | 8/1981 | Hallenbeck et al. | 72/453.03 |
| 4,559,807 | 12/1985 | Ganago et al. | 72/453.03 |
| 4,646,555 | 3/1987 | Postupack | 72/453.03 |
| 4,932,237 | 6/1990 | Hatfield | 72/452 |
| 4,967,586 | 11/1990 | Hecht | 72/450 |
| 5,253,572 | 10/1993 | Uehara et al. | 72/453.04 |

FOREIGN PATENT DOCUMENTS

| | | |
|---|---|---|
| 0232768 | 1/1987 | European Pat. Off. . |
| 0417370 | 9/1989 | European Pat. Off. . |
| 1515360 | 1/1971 | Germany . |
| 1465115 | 11/1971 | Germany . |
| 3235040 | 9/1982 | Germany . |
| 2055639 | 8/1980 | United Kingdom . |
| 9309911 | 11/1992 | WIPO . |

*Primary Examiner*—David Jones
*Assistant Examiner*—Rodney A. Butler
*Attorney, Agent, or Firm*—Joseph W. Berenato, III

[57] ABSTRACT

A pressing tool for transforming workpieces includes a first fixed position die for transforming the workpiece. A second die cooperates with the first die in transformation of the workpiece, and the second die is coupled to and movable in response to operation of a forward feed device. The forward feed device comprises a rough feed device for relatively rapidly moving the second die toward the workpiece, and a fine feed gear for relatively slowly moving the second die toward the workpiece. The fine feed gear is coupled to and movable with the rough feed device. The forward feed device causes control over movement of the forward feed device to be shined from the rough feed device to the fine feed gear upon engagement of the second die with the workpiece.

30 Claims, 4 Drawing Sheets

TOOL FOR TRANSFORMING WORK PIECES

FIELD OF INVENTION

The invention presents a tool for the transforming, especially pressing of work pieces, with a mobile transforming die and a forward feed device for forward feeding it.

BACKGROUND OF THE INVENTION

Such tools are often used for pressing bushes, cable lugs or similar items onto a work piece, but also for cutting, punching or similar activities. Primarily used were hydraulic tools. For example, DE-OS 32 35 040 presents a tool in which the transforming die is moved with the help of a plunger piston in which a control device is concentrically slidable. The control device rests against a gear which is moved in the direction of the control device when the plunger piston moves with a fraction of the speed of the plunger piston. When the transforming die makes contact with the work piece which is to be pressed, the control device is connected with the plunger piston so that it moves with the same speed as the plunger piston. The control device has a locking device which blocks the flow of the air-oil to the working area of the cylinder when the plunger piston reaches a certain pre-set position. This means that thinner work pieces are pressed weaker, i.e. with a smaller deformation degree than thick work pieces.

Another hydraulically actuated tool is described in EP-A-0 232 768. This tool has a low-pressure cylinder and a high-pressure cylinder which can be connected with the air-oil supply to the tool. They are connected to where it is possible to transport a large amount of oil-air into the working cylinder of the tool in the low-pressure range by moving hand levers relatively little, which move the moveable piston in order to obtain a rapid forward feed. When the transforming die makes contact with the work piece which is to be transformed, the high-pressure pump kicks in without any change-over processes. Once the work piece is deformed, the high-pressure safety valve can be opened with the push of a release button. It is possible to arrive at a combination of the principle from DE-OS 32 35 040.

The known hydraulic tools all have a relatively complicated structure, whereby the parts which come in contact with the hydraulic fluid must be built very precisely. Therefore, the invention was charged with designing a tool as described in the introduction which can be produced at a lower cost.

SUMMARY OF THE INVENTION

This problem was solved by equipping the forward feed device with a rough forward feed device for the rapid forward feed of the transforming die until it makes contact with the work piece, as well as with a fine feed gear for the further forwarding of the transforming die so it can work on the work piece, whereby the fine feed device has defined initial and final positions and is coupled with the rough forward feed device to where the fine feed device is moved into the direction of its final position when the rough forward feed device is operated.

Based on the fact that a mechanical fine feed gear is used, the production costs are considerably lower even if an hydraulic pump is used for the rough forward feed device. It is possible to achieve a coupling of the movement of the rough forward feed device and the fine feed gear to where the fine feed gear is put in the direction of its final position in a certain ratio when the rough forward feed device is moved. This means that the farther the rapid forward feed moves forward with the help of the rough forward feed device, the shorter the distance to the final position. This in turn means that the smaller the cross section of the work piece, the smaller the degree of its deformation. This last scenario is especially desirable for attaching cable lugs to cables.

The invention requires that the fine feed gear is located between the rough forward feed device and the transforming die so that the distance between the two can be adjusted via the fine feed gear. This allows for the rough forward feed device to operate from the end which lies opposite the transforming die. This does not preclude a reverse arrangement.

Furthermore, the invention requires that the fine feed gear has a clearing device which works in the area of the final position and allows a return of the transforming die. Depending on the type of fine feed gear, this clearing device can have different shapes. It should provide relief for the fine feed gear and the rough forward feed device in that the resilliencies which frequently occur in work piece deformations and the expansion of the tool can be taken into consideration and the work piece can be removed from the tool.

The invention also calls for coupling the rough forward feed device and the transforming die parallel to the fine feed gear through a flexible joining element, whereby the joining element keeps the rough forward feeding device and the transforming die at a distance during the rapid forward feed so that the fine feed gear is disengaged, and whereby the joining element has such elasticity that the fine feed gear is able to engage when or after the transforming gear makes contact with the work piece. It can be engaged frictionally or positively.

Furthermore, the fine feed gear can have an actuator and a switch or coupler which is/are triggered when the fine feed gear is engaged.

The fine feed gear can have different designs. For example, a curved path gear can be used whereby the curved path must not necessarily work on a frictional basis but can have a toothed gear engagement instead. It is advantageous for the curved path gear to have a pivoting curved path element with a curved path which has an ascending slope which causes a fine feed of the transforming die when the curved path element is twisted. In a special design the curved path element can be a cam plate with a curved path on its front. It should have an indentation at the end of the ascending slope in order to allow the transforming die to return in accordance with the above referenced release device.

Another characteristic of the invention is that the curved path element has a limit stop which is such that the curved path element moves towards the limit stop during rapid forward feed, and in doing so is placed in the direction of its final position in a turning motion. This is a particularly easy solution for the coupling of the rough forward feed device and the fine feed gear in the sense that the fine feed gear is placed in the direction of its final position when the rough forward feed is operated. This means the longer the distance of the rapid forward feed until it makes contact with the work piece, the smaller the deformation of the work piece.

It should be possible to turn the curved path element from its initial into its final position against the effect of a spring in order to allow a defined return rotation. The curved path element can have a driving roller conveyor on which a driving roller rests in the engagement position with the fine feed gear. The driving roller conveyor can simultaneously be the curved path. Furthermore it is possible that the curved path element runs on bearings on the transforming die and the driving roller runs on bearings on the rough forward feed device. An alternative is that the driving roller and curved path element are connected to the rough forward feed device and that the curved path element has a separate curved path for the device on the transforming die.

Another characteristic of the invention is that the fine feed gear has a lever gear which connects the rough forward feed device and the transforming die, for example, in the form of a crank mechanism with two articulated arms whose angle position to each other can be adjusted. In one example of the invention, one of the articulated arms has a joint extension which rests on the limit stop so that the angle position of the articulated arms changes during rapid forward feed in the direction of their final position. This model, too, ensures that, in accordance with the basic thoughts of the invention, the larger the rapid forward feed with the help of the rough forward feed device, the smaller the remaining forward feed which must be carried out by the fine feed gear.

An alternative is that the link joint between the articulated arms has a guiding device which ensures that the angle position of the articulated arms changes in the direction of their final position when a rapid forward feed occurs. In both instances it should be possible for the limit stop or the guiding device respectively to change the angels via an actuation device.

The actuation device should have a pivoting cam plate which has an ascending slope, whereby the cam plate has an indentation at the end of its ascending slope. Finally, it must be ensured that the angle position of the articulated arms can be changed in excess of their straight position in order to achieve a so-called excess dead point position, which means that the above mentioned relief sets in.

BRIEF DESCRIPTION OF THE DRAWINGS

The drawing shows the invention in more detail with the help of several examples.

FIG. (1) shows the side view with a partial section of a tool in accordance with the invention;

Figure 1:
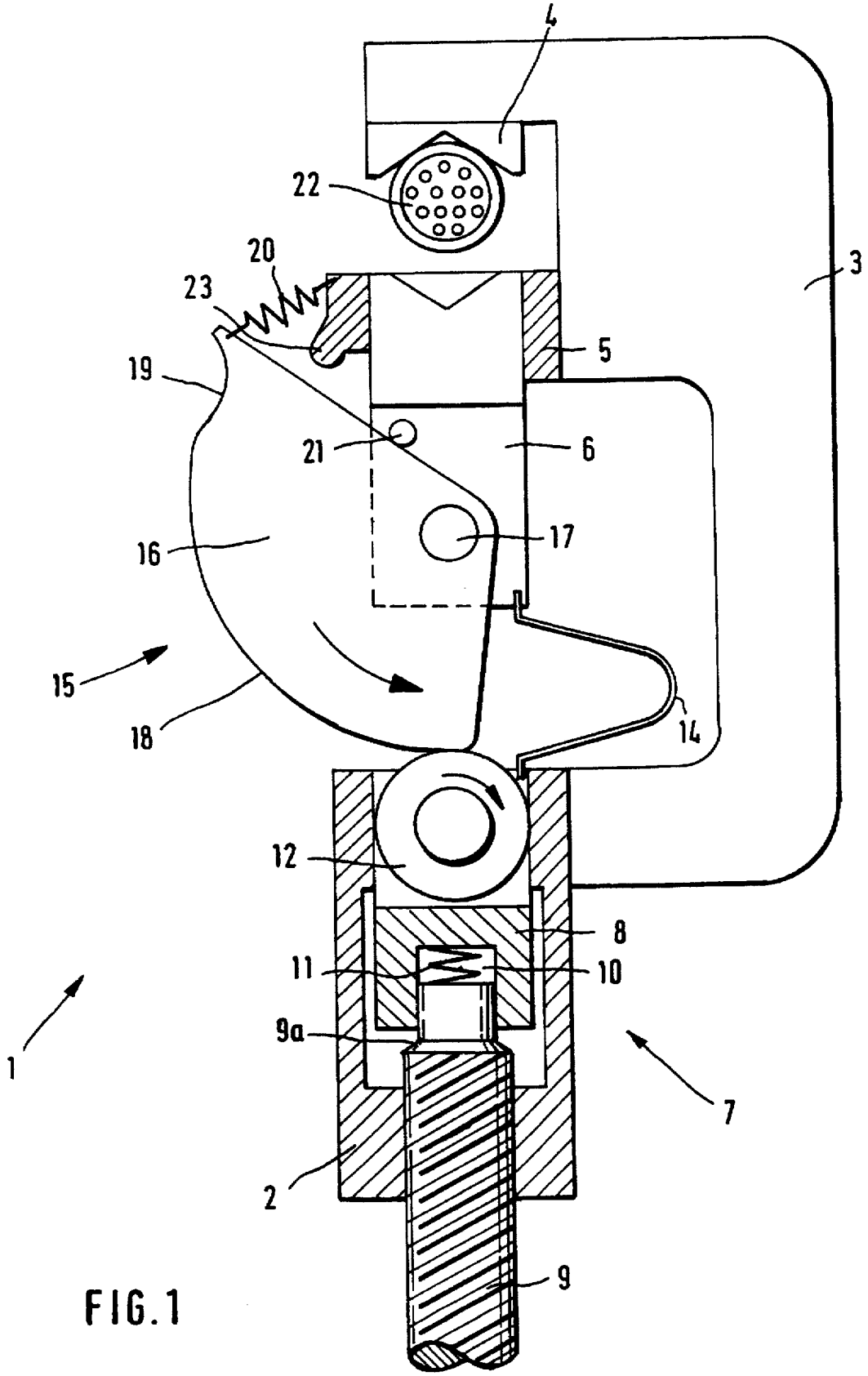
Figure 2:
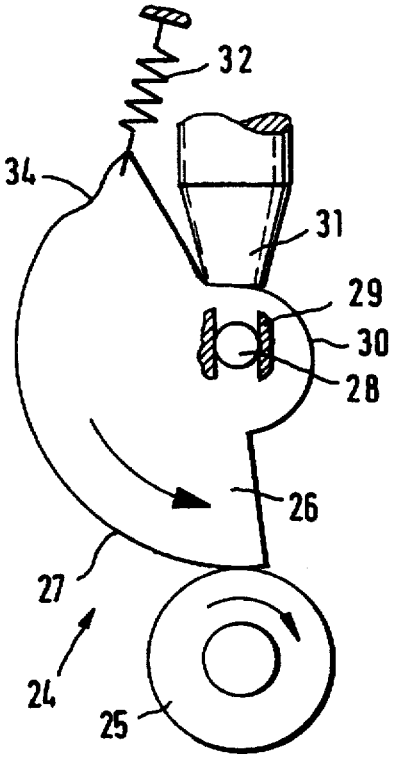
Figure 3:
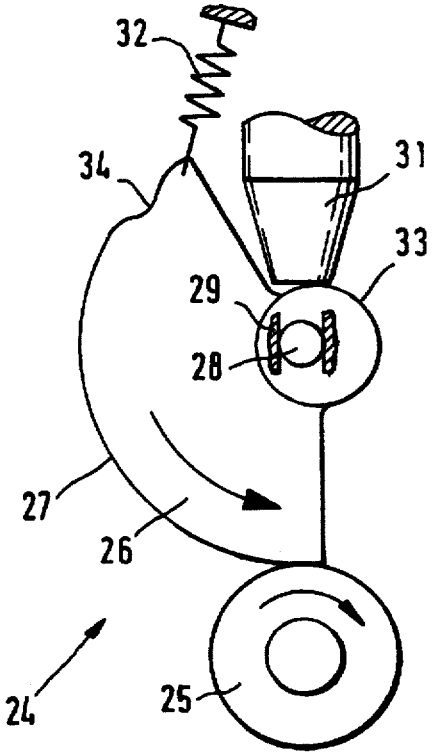
Figure 4:
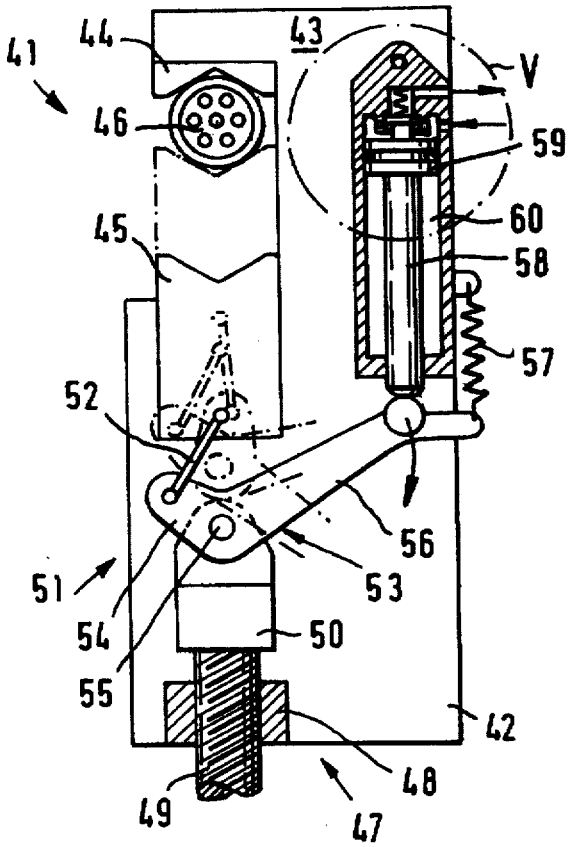
Figure 5:
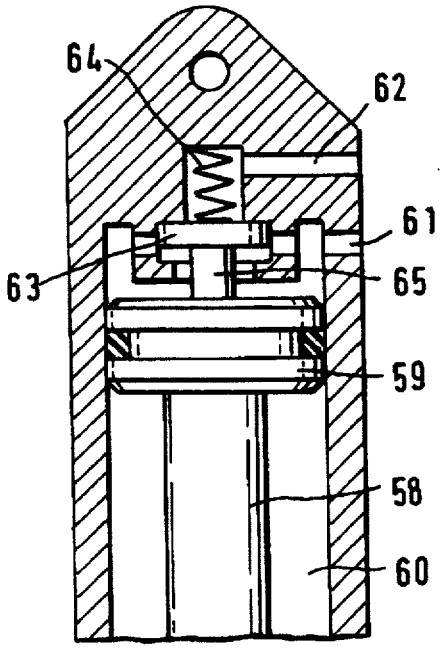
Figure 6:
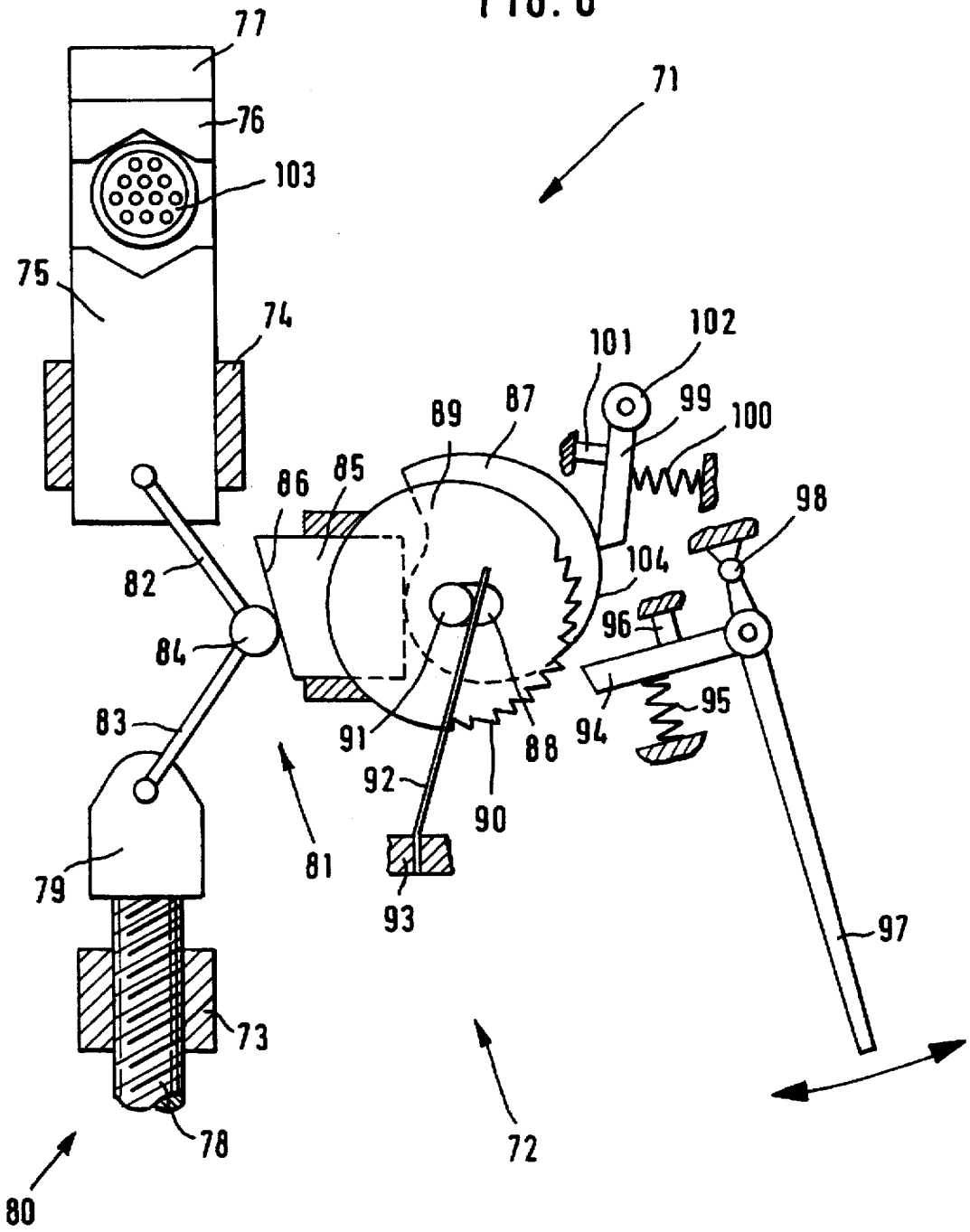

FIG. (2) shows a side view of a fine feed gear for a tool as shown in FIG. (1);

FIG. (3) shows a side view of another fine feed gear for the tool shown in FIG. (1);

FIG. (4) shows a side view of another tool in accordance with the invention;

FIG. (5) shows a profile of an enlargement of the upper part of the actuator of the tool in accordance with FIG. (4); and FIG. (6) shows a side and a schematic view of a third example of the tool in accordance with the invention.

DETAILED DESCRIPTION OF THE INVENTION

The tool (1) shown in FIG. (1) has a basic body (2), of which a sectional view is shown, and an adjoining toolholder (3) which carries a top tool (4). In a cantilever (5) a corresponding transforming die (6), which serves as a lower tool, is guided translationally, i.e. vertically moveable in the presented drawing.

A rough forward feed device (7) is in the basic body (2), which in general consists of a vertically guided slide (8) and a spindle (9) with a relatively strong thread pitch. Instead of the spindle (9), other elements such as wedges, cam plates, etc. are possible. The spindle (9) moves in direction of its longitudinal axis when it rotates. Its upper tip rests in a corresponding recess (10) where it is propped against the slide (8) via a pressure spring (11).

In the upper part of the slide (8) a coil is pivoting around an horizontal axis. It is connected to an electric actuator which is not described in detail at this point—mechanical actuators are also possible—and juts out over the upper end of the slide (8). The slide (8) is connected to the transforming die (6) through a leaf spring (14) which attempts to keep both parts at a certain distance.

A fine feed gear (15) is allocated to the coil (12). A cam plate (16) is part of the coil which is pivoting freely via a horizontal axis (17) on the transforming die (6). On its face it has a curved path (18) whose distance to the axis (17) increases as it goes up. There is a shallow indentation (19) at the end of the curved path (18). A tension spring (20) is linked to it which is connected to the cantilever (5) and attempts to turn the cam plate (16) clockwise. A limit stop (21) on the transforming die (6) limits the movement of the cam plate (16) clockwise.

In the shown position the rough forward feed device (7), fine feed gear (15) and transforming die (6) are all in their initial position, the largest distance being between the top tool (4) and transforming die (6). A work piece (22)—in this instance a cable with a cable lug which is to be pressed on—can be placed in the space between the transforming die (6) and the top tool (4). Then the spindle (9) is turned in such a direction that the slide (8) and therefore the transforming die (6) are moved in the direction of the work piece (22) with comparatively high speed. The cam plate (16) makes contact only after a short distance with a projecting part (23). If moved forward further, this projecting part (23) ensures that the cam plate (16) is pivoted counter-clockwise. The closer the transforming die (6) gets to the work piece (22), the more the cam plate (16) is turned counter-clockwise.

When the transforming die (6) makes contact with the work piece (22), the spindle (9) can be turned further until a shoulder (9*a*) makes contact with the slide (8) and triggers a contact, which in turn triggers the actuation for the coil (12). The coil (12) is turned clockwise. This causes the cam plate (16) to push the transforming die (6) upwards due to the ascending slope of the curved path (18). This deforms the work piece. This is only possible through the remainder of the curved path (18) whose span gets smaller, the smaller the cross section of the work piece (22) gets. The spindle (9) is self-locking so that the coil (12) can rest against the spindle (9). In the final position the coil (12) moves into the indentation (19) which relieves the transforming die (6) and thus now only rests against the work piece (23) due to the effect of the leaf spring (14). The rough forward feed device (7) can move back, and the work piece (22) can be removed. The cam plate (16) is turned back into its initial position by the spring (20). After the spindle (9) moves back further, a new work piece can be inserted.

The tool (1) shown in FIG. (1) can be modified in that the coil (12) and the cam plate (16) are reversed, i.e. the cam plate (16) is run on bearings on the slide (8) and the coil (12) is run on bearings on the transforming die (6), whereby the cam plate (16) is actuated.

FIGS. (2) and (3) show a modification of the tool (1) in accordance with FIG. (1), whereby only the design of the fine feed gear (24) is shown. In the example, in accordance with FIG. (2), the fine feed gear (24) consists of a coil (25)

and a circle segment plate (26). Coil (25) is the counterpart to coil (12) in tool (1) in accordance with FIG. (1), while the circle segment plate (26) is the counterpart to the cam plate (16) as far as its function is concerned.

The circle segment plate (16) has a circuit (27) on its front with which it touches the coil (25). It is pivoting and vertically moveable through a stud (28) in a connecting link (29) and is run on bearings on the tool, which is not shown here in detail. The circle segment plate (26) has a circuit (30) in the area of the stud (28) on which a transforming die (31) rests. Furthermore, the circle segment plate (26) is prestressed clockwise by a tension spring (32). The circuit (27) has an indentation (34) in the area of the tension spring (32).

When the coil (25) is shifted vertically with the help of the rough forward feed device, which is not displayed in detail in this drawing, the circle segment plate (26) and therefore the transforming die (31) are pushed upward until they make contact with the work piece. It is possible to have a limit stop which corresponds to the limit stop (21) so that the circle segment plate (26) is turned counterclockwise when the rapid forward feed occurs. When it makes contact with the work piece, the actuation of the coil (25) is triggered. This causes the circle segment plate (26) to turn counterclockwise. This in turn causes the ascending slope of the curved path (30) to become active in that the transforming die (31)—now, however, with considerable slower speed—is further pushed upwards vertically, and the work piece is deformed until the coil (25) moves into the indentation (34) and the above referenced relief sets in.

FIG. (3) shows a modification of FIG. (2), whereby we are referencing the descriptions in FIG. (2) when we talk about parts which are identical. Instead of a curved path (30), a circular cam path (33) is used on which the transforming die (31) rests. By turning the circle segment plate (26) it is possible to exceed the dead center of the cam path (33) so that the transforming die (31) is relieved. This makes it easy to remove the work piece. The circle segment plate (26) can be turned back after the rough forward feed device is moved back.

The tool (41) shown in FIGS. (4) and (5) has a basic body (42) which widens upward into a toolholder (43) which carries a top tool (44). A transforming die (45) is run slidable in the direction of the top tool (44) in the basic body (42). When the transforming die is moved towards the top tool (44), it can deform a work piece (46).

There is a rough forward feed device (47) in the lower part of the basic body (42) which as a self-locking spindle (49) which is run on bearings in a thread. This spindle engages with a slide (50) which is translational and concentric in reference to the transforming die (45).

The transforming die (45) and the slide (50) are connected via a fine feed gear (51) which consists of a connecting rod (52) which is linked to the transforming die (45) and a toggle lever (53). The toggle lever (53) has a toggle lever arm (54) which is connected flexibly with the connecting rod (52). The connecting rod (52) is run on bearings on the slide (50) via a horizontal axis (55) and has an elongated toggle lever extension (56). Its free end is pushed against the lower end of a connecting rod (58) by a tension spring (57) which is connected with a piston (59), which in turn can be moved vertically in an hydraulic cylinder (60). The hydraulic cylinder (60) is fixed to the tool holder (43).

The hydraulic cylinder (60) has an hydraulic inlet (61) which can be connected to an hydraulic fluid supply in the form of a hand pump, for example. Furthermore, there is an hydraulic outlet (62) which allows the hydraulic fluid to flow back. There is a vertically moveable valve disk (63) at the beginning of the hydraulic outlet (62) which is impinged on by a pressure spring (64). An extension (65) of the piston rod (58) acts on the valve disk (63) in the shown position.

When a rapid forward feed occurs with the help of the spindle (49), the piston rod (58) remains in the position indicated and forms a limit stop for the toggle lever extension (56). The valve disk (63) blocks the hydraulic outlet (62). The transforming die (45) is moved in the direction of the work piece (46), whereby the toggle lever (53) is moved clockwise due to the contact on the piston rod (58). This is shown by the hatched areas. This means that the more the path caused by the rapid forward feed and therefore the smaller the cross section of the work piece (46), the shorter the remaining stroke of the fine feed gear (51) to its final position. The transforming die (45) reaches the work piece (46) before the extended position of the toggle lever arm (54) and the connecting rod (52). Since no strong force can be exerted with the rough forward feed device (47), the rapid forward feed is interrupted.

With the help of a pump, which is not shown in detail in the drawing, the hydraulic fluid then is moved into the free space above the piston (59) via the hydraulic inlet (61). This causes the piston (59) and the piston rod (58) to move downward, whereby the resulting pressure keeps the valve disk (63) in the lifted position, i.e. the hydraulic outlet (62) remains closed. The toggle lever (53) is turned clockwise further which causes the transforming die (45) to move in the direction of the top tool (44) in order to deform the work piece (46). This movement is sustained until the connecting rod (52) and the toggle lever (53) are extended, i.e. have reached their upper dead center.

After this upper dead center and therefore an easy return movement of the transforming die (45) is exceeded, a pressure release in the hydraulic cylinder (60) occurs so that the pressure spring (64) pushed the valve plate (63) down and opens the hydraulic outlet (62). Now the transforming die (45) can be moved back a little with the help of the rough forward feed device (47), i.e. the spindle (49) in order to compensate for the elastic expansion of the tool holder (43). The tension spring (57) ensures that the toggle lever (53) is swept horizontally counterclockwise and thus ensures that the piston rod (58) and the piston (59) are lifted. As a consequence, the hydraulic fluid, which was pumped into the hydraulic cylinder (60) before, now leaves the hydraulic cylinder (60) through the hydraulic outlet (62).

Instead of the hydraulic cylinder (60) other actuation devices can be used, e.g. cam plates, cams or spindles. In each case it must be ensured that the actuator moves back into its initial position due to the relief of force after the dead center is exceeded.

FIG. (6) shows another variation of a tool (71) in accordance with the invention. It is shown only schematically. The tool (71) has a basic body (72) of which only a lower thread (73) and an upper sliding guide (74) is drawn. A transforming die (75) can be swept vertically in the sliding guide (74). On the opposite side there is a top tool (76) which is attached to a tool holder (77), which in turn is fixed to the basic body (72).

There is a spindle (78) inside the thread (73) which engages with a slide (79). The slide (79)—which is not shown in detail in this drawing—can be moved axially in the basic body (72) just as the slide (8) in the example in accordance with FIG. (1) can be moved axially. Together, spindle (78) and slide (79) form a rough forward feed device (80).

The transforming die (75) and the slide (79) are connected through a fine feed gear (81) with two connecting rods (82, 83), whereby the connecting rods (82, 83) are coupled together via a joint (84). The joint (84) props against a slider (85) which, in the basic body (72), can be shifted laterally to the moving direction of the transforming die (75) or the spindle (78) respectively. The slider (85) has a cocked hub (86) on the side of its joint, whereby the inclination forms an upward acute angle with the axis of the spindle (78).

The slider (85) is located on the backside on a cam plate (87) which is pivoting in a horizontally oblong hole (88). A drive wheel (89), which has ratchet teeth (90) on its face over a part of the circumference, is fixed to the cam plate (87). The arrangement of the bearings of the cam plate (87) and the drive wheel (89) in the oblong hole (88) is determined by a pivot (91) which is spring impinged via a leaf spring (92) so that the cam plate (87) pushes against the slider (85). The oblong hole (88) as well as the chucking (93) of the leaf spring (92) are parts of the basic body (72). This is not shown in detail in this drawing.

The drive wheel (89) acts together with a ratchet lever (94) which makes contact through a pressure spring (95) on a limit stop (96) which is an integral part of the casing. The ratchet lever (94) is connected flexibly with a hand lever (97) which is connected to the basic body (72) via a joint (98) which is an integral part of the casing.

There is a return safety mechanism (99) above the ratchet lever (94) which is pushed against a casing integral limit stop (101) via a pressure spring (100) and thus is kept in a set position. The return safety mechanism (99) is connected to the basic body (72) via a joint (102).

The tool (71) works as follows. Initially all parts are in the position indicated. By turning the spindle (78), the rough forward feed device (80) is triggered, which causes the transforming die (75) to move quickly towards the work piece (103) which rests against the top tool (76). The joint (84) rests on the contact surface (86) of the slider (85) and moves up the inclination. This means that the angle between the two connecting rods (82, 83) becomes larger. The larger the distance covered by the rough forward feed device (80), and therefore the smaller the cross section of the work piece (103), the larger the angle. The slider (85) remains in the position indicated, i.e. with a rapid forward feed the lateral pressure on the slider (85) is smaller than the leaf spring (95) which acts on the pivot (91) in the opposite direction.

When the transforming die (75) makes contact with the work piece (103), the force component which acts laterally on the slider (85) increases. This means that the slider (85) and therefore the cam plate (87) move against the effect of the leaf spring (92) to the right in the presented diagram, whereby the pivot (91) moves inside the oblong hole (88). Since the drive wheel (89) which is attached to the cam plate (87) is moved also, its ratchet teeth (90) engage with the ratchet lever (94) and the return safety mechanism (99). Now the drive wheel (89) can be moved clockwise step by step by moving the hand lever (97) in the direction of the double arrow, whereby the return safety mechanism prevents the drive wheel (89) from returning. This means that the cam plate (87) is turned correspondingly. Its curved path (104) with which it rests against the back side of the slider (85) has a shape which ensures that the slider (85) is moved in the direction of the joint (84) when it is turned clockwise. This in turn causes the connection rods (82, 83) to stretch, which causes the transforming die (75) to slide in the direction of the work piece (103) so that the letter is deformed. The spindle (78) maintains its position due to its self-locking bedding in the thread (73).

The slider (85) can be moved past its upper dead center, i.e. past the stretched position. The result is a spontaneous relief so that the transforming die (75) can be moved back with the help of the rough forward feed device (80). Due to the relief, the leaf spring (92) moves the pivot (91) into the position indicated so that the drive wheel (89) disengages from the ratchet lever (94) and the return safety mechanism (99). With the help of a spring arrangement, which is not shown in detail in this drawing, a return movement of the cam plate (87), the slider (85) and the connecting rods (82, 83) can be effected until the initial position shown in the drawing is reached again.

I claim:

1. Tool for transforming, especially pressing workpieces (22, 46, 103), with a mobile transforming die (6, 31, 45, 75) and a forward feed device for its feed motion, characterized by the fact that the forward feed device has a rough forward feed device (7, 47, 80) for the rapid forward feed of the transforming die (6, 31, 45, 75) until it touches the workpiece (22, 46, 103), upon the transforming die touching the workpiece a fine feed gear (15, 24, 51, 81) is actuated for further moving the transforming die (6, 31, 45, 75) for the purpose of transforming the workpiece (22, 46, 103), whereby the fine feed gear (15, 24, 51, 81) has defined initial and final positions and is coupled to and moves with the rough forward feed device (7, 47, 80) so that the fine feed gear (15, 24, 81) moves toward said final position in cooperation with movement of the rough forward feed device (7, 47, 80).

2. Tool in accordance with claim 1, characterized by the fact that the fine feed gear (15, 24, 51, 81) lies between the rough forward feed device (7, 47, 80) and the transforming die (6, 31, 45, 75) so that the distance between the rough forward feed device and the transforming die is changed through the fine feed gear (15, 24, 51, 81).

3. Tool in accordance with claim 1, characterized by the fact that the rough forward feed device (7) and the transforming die (6) are coupled parallel to the fine feed gear (15) through a flexible joining element (14), whereby the joining element (14) keeps the rough forward feed device (7) and the transforming die (6) at a distance during a rapid feed so that the fine feed gear (15) is disengaged, and whereby the joining element (14) is flexible so that the fine feed gear (15) is engaged upon the transforming die (6) touching the work piece (22).

4. Tool in accordance with claim 1, characterized by the fact that the fine feed gear (15) has an actuator comprising one of a switch and a coupler which is triggered when the fine feed gear (15) is engaged.

5. Tool in accordance with claim 1, characterized by the fact that the fine forward gear (15, 24) is a curved path gear.

6. Tool in accordance with claim 1, characterized by the fact that the fine feed gear (51, 81) has a lever gear (52, 53, 82, 83) which connects the rough forward feed device (47, 80) and the transforming die (45, 75).

7. Tool in accordance with claim 5, characterized by the fact that the curved path gear (15, 24) has a pivoting curved path element (16, 26) with a curved path (18, 30,. 33) which has a slope which, when the curved path element (16, 26) is rotated, causes a fine forward move of the transforming die (6, 34).

8. Tool in accordance with claim 7, characterized by the fact that the curved path element (15) is a cam disk (16) with a curved path (18) on its face.

9. Tool in accordance claim 7, characterized by the fact that the curved path element (16, 26) is rotated from the initial position into the final position against the effect of a spring (20, 32).

10. Tool in accordance with claim 7, characterized by the fact that the curved path element (16, 26) has a driving roller conveyor (18, 27) on which a driving roller (12, 25) is positioned in an engaging position with the fine feed gear (7, 24).

11. Tool in accordance with claim 8, characterized by the fact that the curved path (18) has an indentation at the end of its ascending slope.

12. Tool in accordance with claim 8, characterized by the fact that there is limit stop (23) for the curved path element (16) which is such that the curved path element (16) moves towards the limit stop (23) when the rapid feed is triggered and thus is turned into the direction of its final position.

13. Tool in accordance with claim 10, characterized by the fact that the driving roller conveyor is also the curved path (18).

14. Tool in accordance with claim 10, characterized by the fact that the curved path element (16) is run on bearings on the transforming die (6) and that the driving roller (12) is run on bearings on the rough forward feed device (7).

15. Tool in accordance with claim 10, characterized by the fact that the driving roller (25) and the curved path element (26) are connected with the rough forward feed device and that the curved path element (26) has a special curved path (30, 33) for the contact with the transforming die (31).

16. Tool in accordance with claim 6, characterized by the fact that the lever gear has two articulated arms (52, 54, 82, 83) whose angle position to each other is adjustable.

17. Tool in accordance with claim 16, characterized by the fact that one articulated arm (54) has a joint extension (56) which rests against a limit stop (58) so that the angle position of the articulated arms (52, 54) changes into the direction of their final position when rapid forward feed occurs.

18. Tool in accordance with claim 16, characterized by the fact that a link joint (84) is disposed between the articulated arms (82, 83) and has a guiding device (86) which ensures that the angle position of the articulated arms (82, 83) changes into the direction of their final position when rapid forward feed occurs.

19. Tool in accordance with claim 16, characterized by the fact that the angle position of the articulated arms is changeable past their straight position.

20. Tool in accordance with claim 17, characterized by the fact that the limit stop (58) moves with the actuation device (58, 64), corresponding to a change in angles.

21. Tool in accordance with claim 20, characterized by the fact that the actuation device (87–102) has a pivoting cam plate (87) which has an ascending slope.

22. Tool in accordance with claim 21, characterized by the fact that the cam plate has an indentation at the end of its ascending slope.

23. A pressing tool for transforming workpieces, comprising:

a) a first fixed position die for transforming a workpiece;

b) a second die for cooperation with said first die in transformation of the workpiece, said second die coupled to and movable in response to operation of a forward feed device; and c) said forward feed device comprising a rough feed device for relatively rapidly moving said second die toward the workpiece and a fine feed gear for relatively slowly moving said second die toward the workpiece, said fine feed gear coupled to and movable with said rough feed device, and said forward feed device having means for causing control over movement of said forward feed device to be shifted from said rough feed device to said fine feed gear by engagement of said second die with the workpiece.

24. The tool of claim 23, wherein:

a) said rough feed device has a first linearly movable portion longitudinally aligned with said first and second dies; and b) said fine feed gear has a portion rotatable on an axis extending transverse to said rough feed device movable portion.

25. The tool of claim 24, wherein:

a) said rough feed device first portion is rotatable about the longitudinal axis thereof.

26. The tool of claim 25, wherein:

a) said fine feed gear is interposed between said rough feed device and said second die.

27. The tool of claim 26, wherein:

a) said fine feed gear portion includes a cam having an arcuate surface, said surface including a recess defining a final position for said cam upon rotation thereof.

28. The tool of claim 26, wherein:

a) means are interposed between said fine feed gear and said rough feed device for adjusting the distance between said rough feed device and said second die.

29. The tool of claim 27, wherein:

a) a drive roller is interposed between said rough feed device and said cam for rotating said cam upon engagement of said second die with the workpiece.

30. Tool for transforming, especially pressing workpieces (22, 46, 103), with a mobile transforming die (6, 31, 45, 75) and a forward feed device for its feed motion, characterized by the fact that the forward feed device has a rough forward feed device (7, 47, 80) for the rapid forward feed of the transforming die (6, 31, 45, 75) until it touches the workpiece (22, 46, 103), upon the transforming die touching the workpiece a fine feed gear (15, 24, 51, 81) is actuated for further moving the transforming die (6, 31, 45, 75) for the purpose of transforming the workpiece (22, 46, 103), whereby the fine feed gear (15, 24, 51, 81) has defined initial and final positions and is coupled to and moves with the rough forward feed device (7, 47, 80) so that the fine feed gear (15, 24, 81) moves toward said final position in cooperation with movement of the rough forward feed device (7, 47, 80) and wherein the fine feed gear (15, 24, 51, 81) has a release device (19) in proximity to the final position of the fine feed gear and which allows the transforming die (6, 31, 45, 75) to return.

* * * * *